US005265815A

United States Patent [19]

Soyka et al.

[11] Patent Number: 5,265,815

[45] Date of Patent: Nov. 30, 1993

[54] MULTI-CABLE STORAGE AND RETRIEVAL DEVICE

[75] Inventors: Thomas J. Soyka, Alexandria; Edwin W. Wentworth, Dale City, both of Va.; Lawrence T. Marshall, Schwetzingen, Fed. Rep. of Germany; Edward A. Antesberger, Fairfax, Va.

[73] Assignee: The United States of America as represented by the Secretary of the Army, Washington, D.C.

[21] Appl. No.: 899,837

[22] Filed: Jun. 17, 1992

[51] Int. Cl.[5] ..... B65H 75/34

[52] U.S. Cl. ..... 242/54 R; 242/85

[58] Field of Search ..... 242/54 R, 85, 84.8, 242/96, 99, 129, 55.3, 132, 137, 137.1, 146, 86, 100, 104, 118.1, 118.41; 206/394, 397, 409

[56] References Cited

U.S. PATENT DOCUMENTS

| | | | |
|---|---|---|---|
| 1,311,758 | 7/1919 | Cowan | 242/55.3 |
| 1,364,031 | 12/1920 | Brenizer | 242/96 |
| 1,474,580 | 11/1923 | Clark et al. | 242/137.1 |
| 1,581,289 | 4/1926 | Prihoda | 242/100 X |
| 1,635,378 | 7/1927 | Mead | 242/146 |
| 2,063,662 | 12/1936 | Doherty | 242/100 |
| 2,442,934 | 6/1948 | Pequet | 242/55.3 |
| 2,711,357 | 6/1955 | Nelson et al. | 242/55.3 X |
| 2,801,303 | 7/1957 | Pailing | 242/96 X |
| 2,954,942 | 10/1960 | Raus | 242/129 |
| 3,647,152 | 3/1972 | Trewella | 242/96 X |
| 4,978,085 | 12/1990 | Letourneau | 242/85 |

*Primary Examiner*—John M. Jillions
*Attorney, Agent, or Firm*—Milton W. Lee; Alain L. Bashore; Anthony T. Lane

[57] ABSTRACT

A multi-cable storage and retrieval device including a housing, multi-cable spool inside the housing, and lockable handle coupled to the spool which projects out one side of the housing. The multi-cable spool includes a spindle with at least two disks centered on the spindle for separating the various cables.

3 Claims, 2 Drawing Sheets

MULTI-CABLE STORAGE AND RETRIEVAL DEVICE

BACKGROUND OF THE INVENTION

1. Field of the Invention

The field of the invention disclosed herein is directed to cable storage devices and more particularly to multi-cable storage and retrieval devices.

2. Description of Related Prior Art

In the prior art, cables were simply thrown intermingled into a large container, or coiled up by hand or on to separate cord reels. Other methods included tying the cables together and retrieving as one large coil. The disadvantages to coiling cables by hand are that the cables often will become knotted or in some other way hard to uncoil. The process can become very strenuous with long lengths or large diameter cables. Cold weather can also make the task of coiling the cable by hand nearly impossible.

The use of separate reels for dispensing several cables also has drawbacks. One is the need to repeat the operation for each cable. A second drawback is that reels leave the cable exposed to the environment which decreases the cables expected life.

The method of coiling cables when tied together introduces a drawback when one of the cables has to be replaced.

There is a need in the prior art for a device which can dispense and retract multiple cables of various diameters into a container that is ready for shipping or storage.

SUMMARY OF THE INVENTION

The invention disclosed herein is directed to a multi-cable storage and retrieval device. A multi-cable spool allows multiple cables of various diameters to be coiled or dispensed within a self-contained housing. The spool includes a spindle with multiple disks spaced at desired intervals, all coupled to a handle which projects out a side of the housing.

The primary objective of this invention is to provide a device which can dispense and retract multiple cables of various diameters into a housing that is ready for shipping or storage.

BRIEF DESCRIPTION OF THE DRAWINGS

A full and complete understanding of the invention can be obtained from the following detailed description of the invention when read in conjunction with the annexed drawing in which.

PREFERRED EMBODIMENTS

Figure 1:
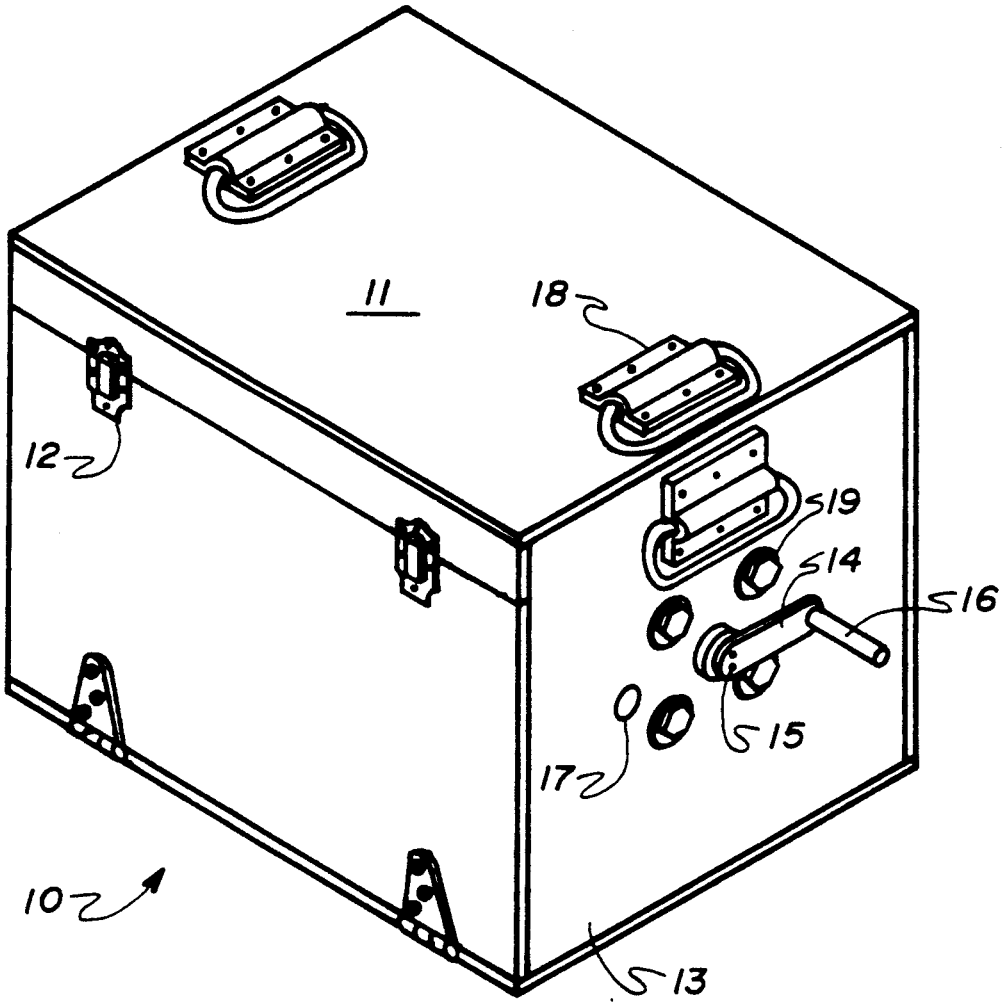
FIG. 1 is a isometric view of the housing and handle of the preferred embodiment.

The preferred embodiment will now be discussed with reference to the drawing figures. FIG. 1 discloses the device which includes housing 10 with lid 11 and latches 12 for releasable closure. On side 13 is located handle 14 which projects out of the side and which is used as a manual crank handle. Handle 14 includes screws 15 which function as a releasable coupling means such that when the device is ready for transportation, screw 15 are removed and handle 14 is reversed with handle lid 16 inserted and locked into hole 17. Housing 10 is transportable with the aid of manual handholds 18. While FIG. 1 discloses a rectangular structure with specific releasable closure means and handle means, it is understood that the invention is not limited to such.

Figure 2:
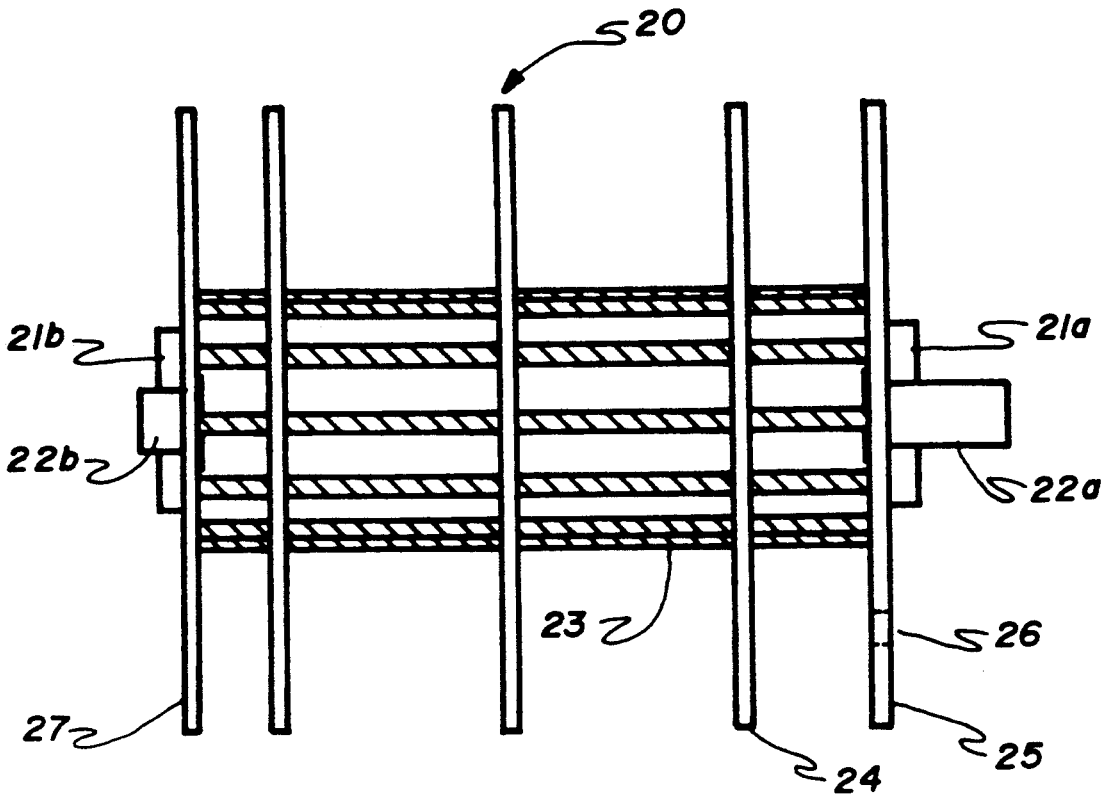
FIG. 2 is a side view of the multi-cable spool of the preferred embodiment.
Figure 3:
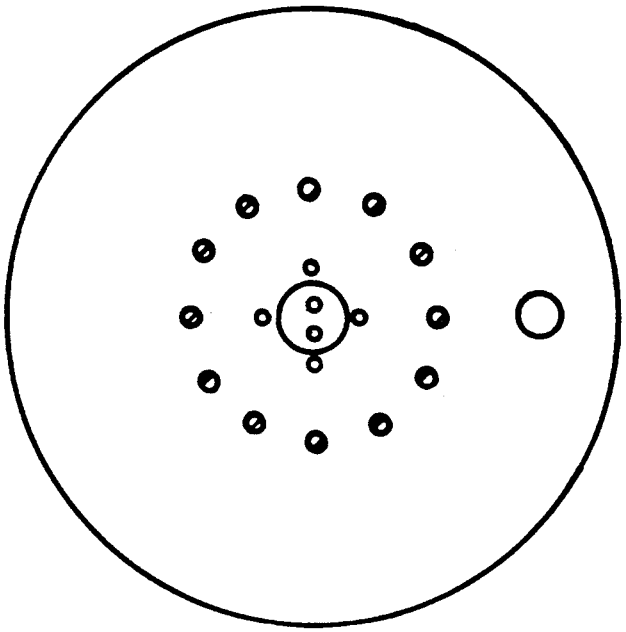
FIG. 3 is a front view of FIG. 2.

FIG. 2 discloses the multi-cable spool 20 which is located within housing 10 of FIG. 1. Multi-cable spool 20 is rotatable on pins **22*a* and 22*b* via bearings 21*a* and 21*b* attached to side wall 13 by bolts 19 of FIG. 1 about an axis parallel to the releasable closure lid 11 of FIG. 1. Handle means 14 is axially coupled to pin 22*a* of FIG. 2 whereby when lid 11 is opened, multiple cables of various diameters may be retracted or dispensed by manual rotation of handle means 14. Parallel end disks 25 and 27 are attached perpendicular on each end of multiple spindle rods 23 equidistant from the center of the inside of end disk 25 and 27. Spindle rods 23 consist in the preferred embodiment of dowell rods about which may be wound cables of various diameters. Partition disks 24 are held around the center and perpendicular to spindle elements 23 between end disks 25 and 27 shown as FIG. 3. End disk 25 of FIG. 2 is located next to pin 22*a* and includes locking hole 26 better seen as element 30 of FIG. 3. When handle 14 of FIG. 1 is reversed and put into the locking position, handle end 16 of FIG. 1 also inserts through hole 26 of FIG. 2 such that spool 20** is also locked in place when the device is ready for transportation.

The number of partition disks 24 and the disk spacing in the partition spacing defined the direction along spindle elements 22 between end disks 25 and 27 and a partition disk such as partition disk 24 or multiple partition disks as shown in FIG. 2 will depend on the number of cables to be utilized and their relative diameters. A larger cable or longer amount will require a larger partition spacing for the particular cable to be wound.

Industrial applicability of this invention includes but is not limited to: the electronics and cable industry.

This preferred embodiment is not intended to restrict the invention to the precise embodiment described.

I claim:

1. A multi-cable storage and retrieval device for dispensing and retracting multiple cables within a housing comprising:

a housing with four sides, a bottom, and releasable closure lid;

a multi-cable spool within the housing rotatable about an axis parallel to said releasable closure lid, the spool further including two parallel end disks attached perpendicular on each end of multiple spindle rods equidistant from the center of the inside of each end disk, the spool rotatable about pins projecting outward from the center of the outside of each end disk, the pins project through the approximate center of two parallel housing sides;

at least one partition disk between and parallel to each end disk with the multiple spindle rods projecting therethrough, each spacing created between an end disk and partition disk or multiple partition disks defined as a partition spacing between which may be wound a cable around the multiple spindle rods;

handle means axially coupled to one of the pins projecting outside one of the housing sides for manual rotation of the spindle, whereby when the lid is opened, multiple cables of various diameters may be retracted or dispensed from at least one partition, by manual rotation of the handle means.

2. The device of claim 1 wherein said handle means includes releasable locking means to allow said handle to be locked in position.

3. The device of claim 1 wherein said partition spacing varies depending on the distance between an end disk and partition disk or multiple partition disks whereby a larger partition spacing will allow winding a greater length of a larger diameter cable.

* * * * *